US010451381B2

(12) United States Patent
Mezynski

(10) Patent No.: US 10,451,381 B2
(45) Date of Patent: Oct. 22, 2019

(54) ADAPTER FOR COUPLING A GRENADE LAUNCHER TO A HANDGUARD

(71) Applicant: AIRTRONIC USA, LLC, Spring Branch, TX (US)

(72) Inventor: Ryan Mezynski, Spring Branch, TX (US)

(73) Assignee: AIRTRONIC USA, LLC, Spring Branch, TX (US)

( * ) Notice: Subject to any disclaimer, the term of this patent is extended or adjusted under 35 U.S.C. 154(b) by 0 days.

(21) Appl. No.: 16/029,484

(22) Filed: Jul. 6, 2018

(65) Prior Publication Data

US 2019/0011219 A1 Jan. 10, 2019

Related U.S. Application Data

(60) Provisional application No. 62/529,383, filed on Jul. 6, 2017.

(51) Int. Cl.
*F41C 27/06* (2006.01)

(52) U.S. Cl.
CPC ..... *F41C 27/06* (2013.01)

(58) Field of Classification Search
CPC ..... F41C 27/06; F41C 27/18; F41C 23/16
See application file for complete search history.

(56) References Cited

U.S. PATENT DOCUMENTS 5,198,600 A * 3/1993 E'Nama ..... F41C 27/00 42/105
5,590,484 A * 1/1997 Mooney ..... F41G 1/16 42/111
5,930,935 A * 8/1999 Griffin ..... F41C 27/06 42/105
6,289,621 B1 * 9/2001 Vendetti ..... F41C 27/18 42/106
6,385,892 B1 * 5/2002 Vendetti ..... F41C 27/00 42/86
7,143,539 B2 * 12/2006 Cerovic ..... F41A 19/58 42/84
7,458,179 B2 * 12/2008 Swan ..... F41G 11/003 42/105
8,991,091 B2 * 3/2015 Griffin ..... F41C 27/06 42/105
9,127,904 B2 * 9/2015 Moore, Jr. ..... F41C 27/00
(Continued)

OTHER PUBLICATIONS

"M203PI EGLM, Quick-Connect M203", http://m203pi.com/ (Year: 2016).*

(Continued)

*Primary Examiner* — Joshua T Semick
(74) *Attorney, Agent, or Firm* — Polsinelli PC

(57) ABSTRACT

Mounting system operable to couple a grenade launcher to a firearm, the mounting system including a rail system operable to be coupled to a firearm, the rail system comprising at least one rail that is mounted on an underside of a barrel of the firearm that is opposite to sights mounted on an upperside of the barrel. The mounting system includes a front lug that is coupled to the barrel in front of the rail system and aligned with the at least one rail. Additionally, the mounting system includes a grenade launcher rail that is operable to be coupled to the grenade launcher and a lug adapter operable to be coupled to the grenade launcher rail and the front lug.

17 Claims, 14 Drawing Sheets

(56) References Cited

U.S. PATENT DOCUMENTS

| | | | | |
|---|---|---|---|---|
| 9,127,906 | B2 * | 9/2015 | Wells | F41G 11/003 |
| 9,599,431 | B2 * | 3/2017 | Griffin | F41C 27/06 |
| 9,599,437 | B2 * | 3/2017 | Eble | F41G 11/003 |
| 10,041,760 | B2 * | 8/2018 | Keller, II | F41C 23/14 |
| 2017/0030678 | A1 * | 2/2017 | Rostetter | F41C 27/18 |

OTHER PUBLICATIONS

"Kley-Zion Bayonet Lug Mount, Free Shipping & No Sales Tax", https://www.botach.com/kley-zion-bayonet-lug-mount/ (Year: 2016).*

"M203EXPIC 40MM Grenade Launcher (Picatinny Rail Mount System)", https://airtronic-usa.com/wp-content/uploads/m203expic.pdf (Year: 2016).*

"Pistol light on a rifle?—AR15.COM", https://www.ar15.com/forums/general/Pistol_light_on_a_rifle_/5-94567842/15/2019, pp. 2-3, (Year: 2009).*

* cited by examiner

ADAPTER FOR COUPLING A GRENADE LAUNCHER TO A HANDGUARD

FIELD

The present disclosure relates to a mounting device for a grenade launcher to a firearm having a handguard.

BACKGROUND

Grenade launchers have been typically designed as standalone units. The standalone unit is designed to handle the rigors of the firing of the grenade and other stresses that are imparted on the grenade launcher through the firing of the grenade as well as field use.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present disclosure is not limited to the precise embodiments and features shown. The accompanying drawings, which are incorporated in and constitute a part of this specification, illustrate an implementation of apparatuses consistent with the present disclosure and, together with the description, serve to explain advantages and principles consistent with the present disclosure.

DETAILED DESCRIPTION

Figure 1:
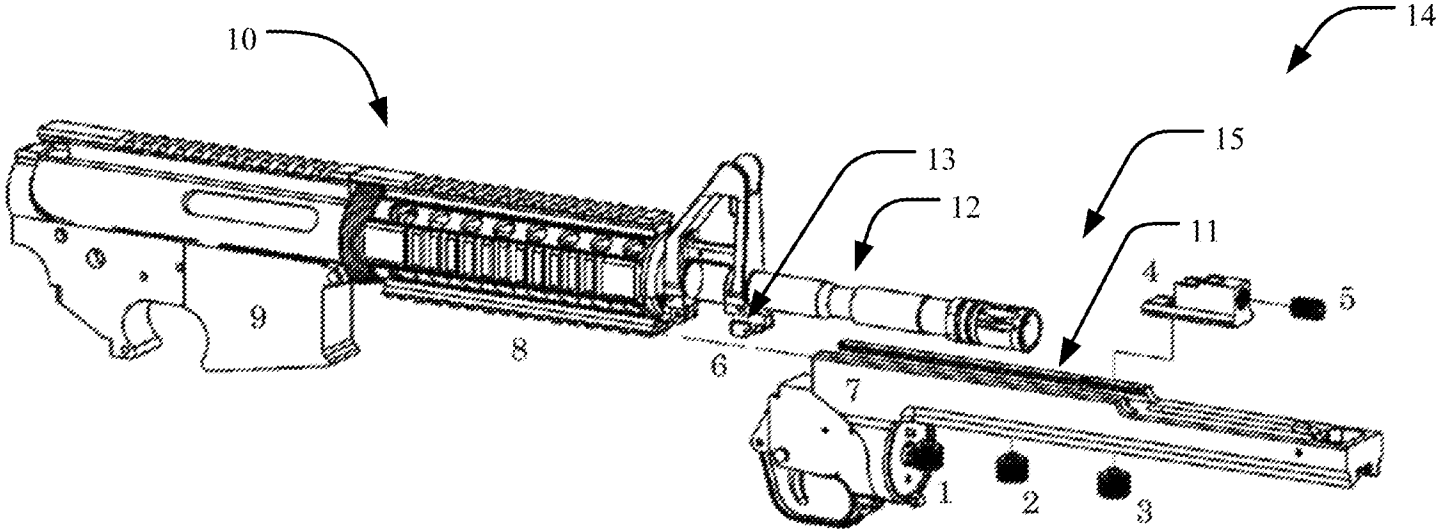
FIG. 1 is an assembly view of a grenade launcher configured to be coupled to a firearm having a quad-rail handguard and a front lug, wherein a lug adapter according to the present disclosure is configured to couple the front lug to the grenade launcher.

The present disclosure provides a system and apparatus for coupling a grenade launcher to a firearm. The aforementioned may be achieved in an aspect of the present disclosure by providing a mounting system operable to couple a grenade launcher to a firearm. The mounting system comprises a rail system operable to be coupled to a firearm, where the rail system comprises at least one rail that is mounted on an underside of a barrel of the firearm that is opposite to sights mounted on an upperside of the barrel. The mounting system also comprises a front lug that is coupled to the barrel in front of the rail system and aligned with the at least one rail and a grenade launcher rail that is operable to be coupled to the grenade launcher. The mounting system also comprises a lug adapter operable to be coupled to the grenade launcher rail and the front lug.

The aforementioned may be achieved in another aspect of the present disclosure by providing a lug adapter operable to couple a grenade launcher rail to a front lug of a firearm. The lug adapter comprises a rail base that is operable to be received by a grenade launcher rail, where the rail base has a first end and a second end, the second end being opposite the first end. The rail base also forms an opening near the first end, where the opening is operable to receive a set screw. The lug adapter also comprises a housing protruding from the rail base at the second end and extending towards the first end, where the housing forms a front lug receiving portion that is operable to receive a front lug of a firearm. The lug adapter further includes an adjustment screw that is operable to be received in an adjustment screw receiving portion formed in the housing, wherein the adjustment screw is operable to engage the housing with the front lug.

Several definitions that apply throughout this disclosure will now be presented. "Coupled" refers to the linking or connection of two objects. The coupling can be direct or indirect. An indirect coupling includes connecting two objects through one or more intermediary objects. Coupling can also refer to electrical or mechanical connections. Coupling can also include magnetic linking without physical contact. "Substantially" refers to an element essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like. "About" refers to almost, nearly, on the verge of, or without significant deviation from the numeric representation. For example, about 20 can be 20, or a small deviation from 20. The use of relational terms such as, but not limited to, "front," "rear," "underside," "upperside," "top," "bottom," "left," "right," "upper," "lower," "down," "downward," "up," "upward," and "side," are used in the description for clarity in specific reference to the figures and are not intended to limit the scope of the present inventive concept or the appended claims. "Near" refers to a point or position located a short distance away. For example, near an end means that the point or position is located within a short distance from the end but is not at the end itself. "Portion" refers to a part of the whole, or less than the whole. For example, a portion of a circle means not the whole or entire circle, but a piece less than the whole circle.

Generally, a system and apparatus for coupling a grenade launcher to a firearm is provided. In an example implementation, a grenade launcher is attached to a firearm via a rail system and a lug adapter, where the lug adapter is operable to add a point of attachment of the grenade launcher to a barrel of the rifle. The grenade launcher includes a grenade launcher rail which slides onto a quad-rail handguard of a firearm. A set of rail launcher set screws lock the grenade launcher to the firearm. To alleviate stress on the handguard created by recoil of the grenade launcher when fired, the lug adapter is also provided which connects the grenade launcher to a front lug located on the bottom of the barrel of the firearm. By connecting the grenade launcher to the front lug via the lug adapter, the stress created by the recoil is directed to the barrel instead of the handguard.

FIG. 1 is an assembly view of a grenade launcher 7 configured to be coupled to a firearm 10 via a mounting system 14 having a rail system 15, a front lug 6, a grenade launcher rail 11, and a lug adapter 4. The rail system 15 includes a quad-rail handguard 8 of the firearm 10 mounted on an underside of a barrel 12 that is opposite to sights mounted on the upperside of the barrel 12. The firearm 10 also includes the front lug 6, which protrudes downward from the underside of the barrel 12 and provides a point of contact to the barrel 12. In an example implementation, as shown, the front lug 6 may be positioned in front of the rail system 15 and aligned with the quad-rail handguard 8. The front lug 6 may be, for example, a standard bayonet lug which receives a bayonet. The lug adapter 4 according to the present disclosure is configured to couple the front lug 6 to the grenade launcher 7. The grenade launcher 7 further includes the grenade launcher rail 11 configured to couple the grenade launcher 7 to the firearm 10. A plurality of launcher rail set screws 1, 2, and 3 are configured to lock the lug adapter 4 to the grenade launcher 7 and the grenade launcher 7 to the firearm 10.

Figure 2:
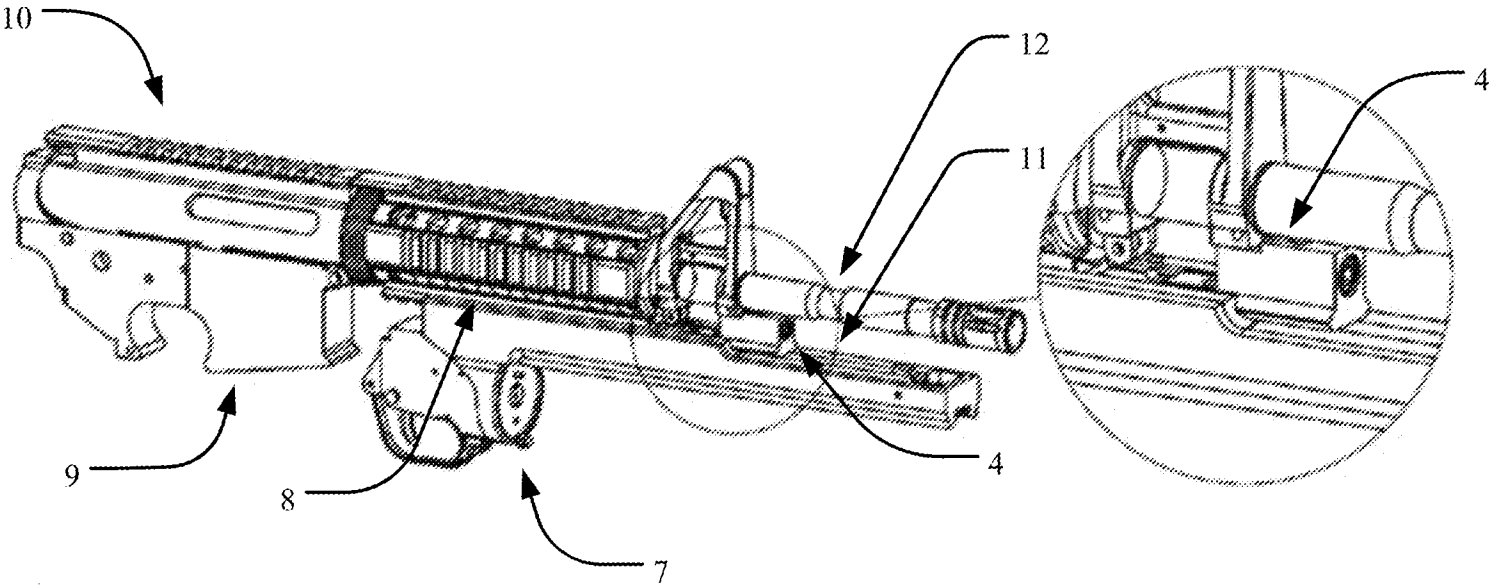
FIG. 2 is an isometric view of an installed configuration of the grenade launcher, lug adapter, and firearm of FIG. 1.

FIG. 2 is an isometric view of an installed configuration of the grenade launcher 7, lug adapter 4, and firearm 10 of FIG. 1. The grenade launcher rail 11 receives the quad-rail handguard 8 and the lug adapter 4 receives the front lug 6. The close up view, in particular, shows the lug adapter 4 contacting the front lug 6.

Figure 3:
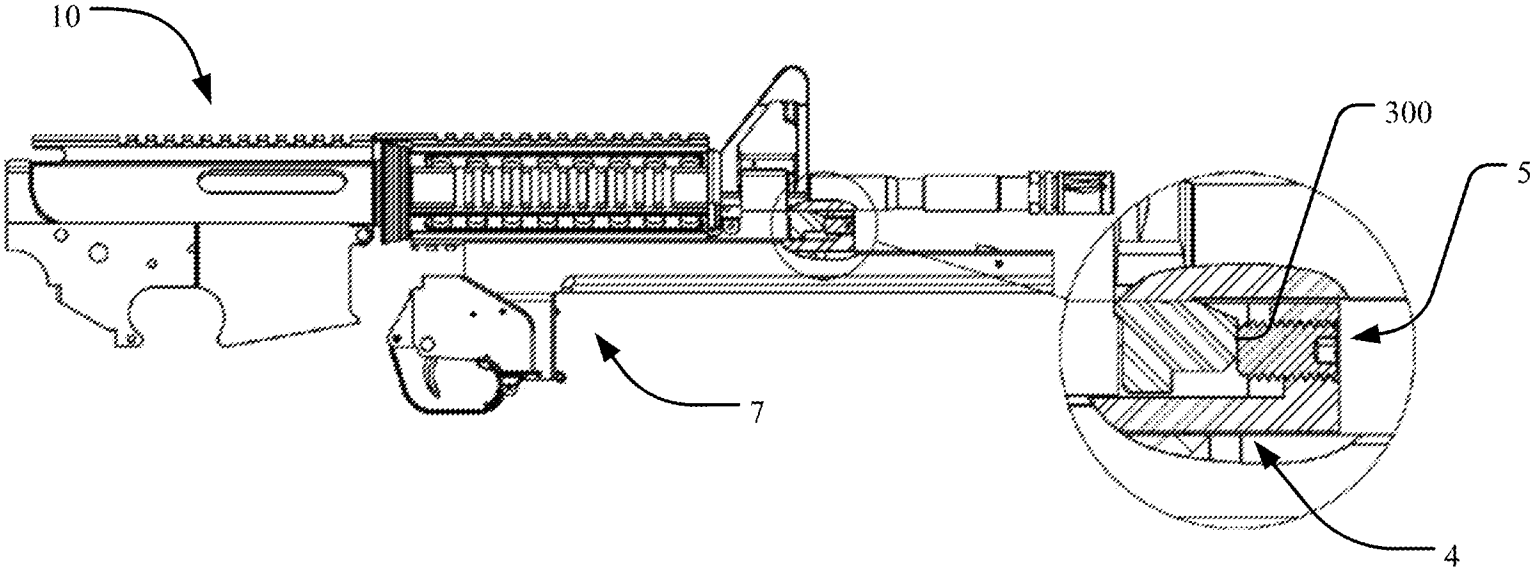
FIG. 3 is partial cut-away view of the grenade launcher and lug adapter of FIG. 2.

FIG. 3 is partial cut-away view of the grenade launcher 7 and lug adapter 4 of FIG. 2. A front face 300 of the front lug 6 is shown contacting the adjustment screw 5. The contact between the front lug 6 and the adjustment screw 5 facilitates transfer of load from the grenade launcher 7 to the barrel 12 of the firearm 10 during use. The adjustment screw 5 may fully back out from the lug adapter 4 and can accommodate front lugs 6 with different dimensions and positions, as well as different rail systems 15.

Figure 4:
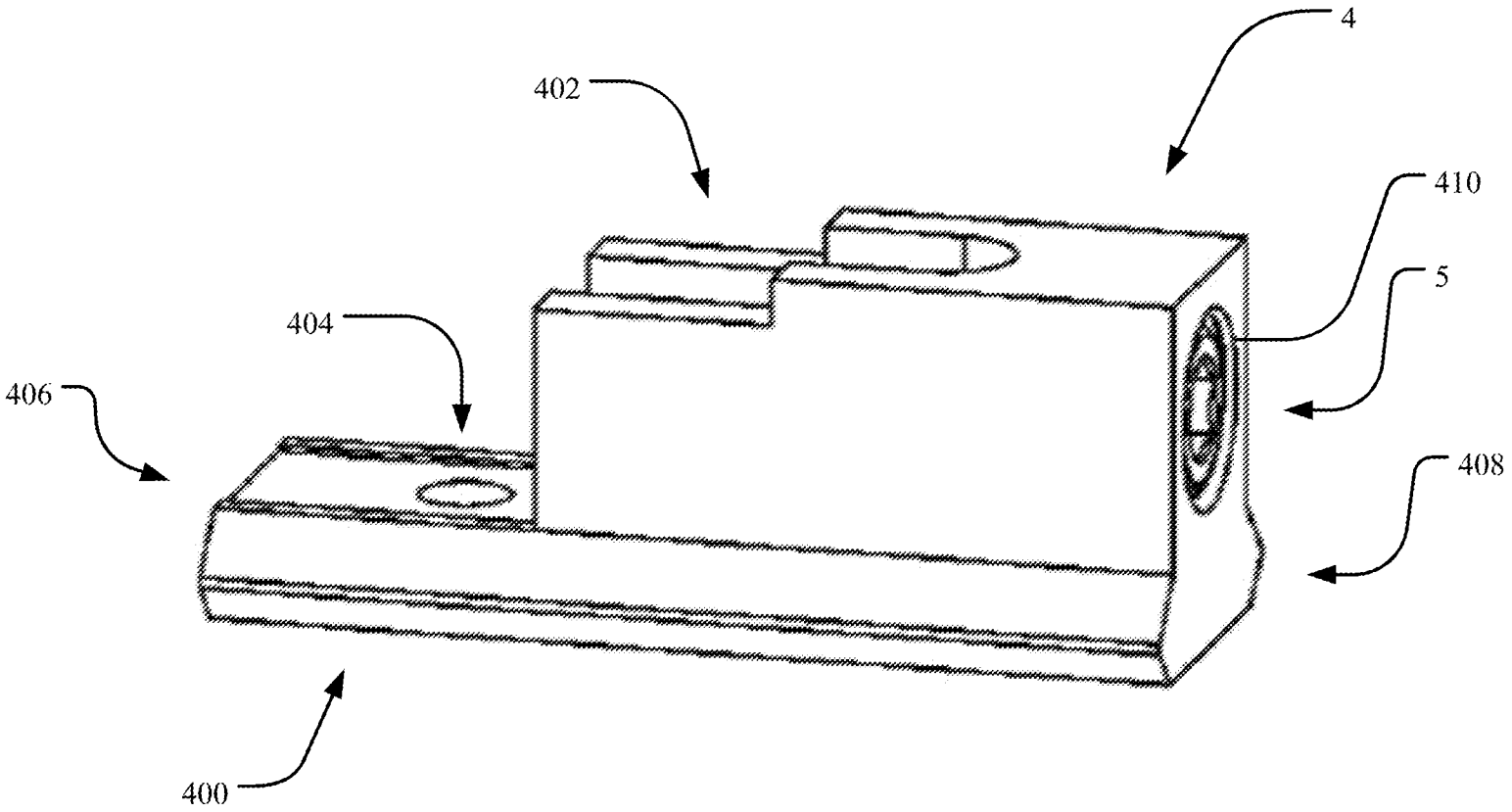
FIG. 4 is an isometric view of the lug adapter according to the present disclosure.

FIG. 4 is an isometric view of a lug adapter 4 according to the present disclosure. The lug adapter 4 includes a rail base 400, housing 402 protruding from the rail base 400, and the adjustment screw 5 received by the housing 402. The rail base 400 forms an opening 404 there through at a predetermined distance from a first end 406. The opening 404 is operable to receive a launcher rail set screw 3 to couple the lug adapter 4 to the grenade launcher 7. The housing 402 extends from a second end 408, wherein the second end 408 is opposite the first end 406.

Figure 5:
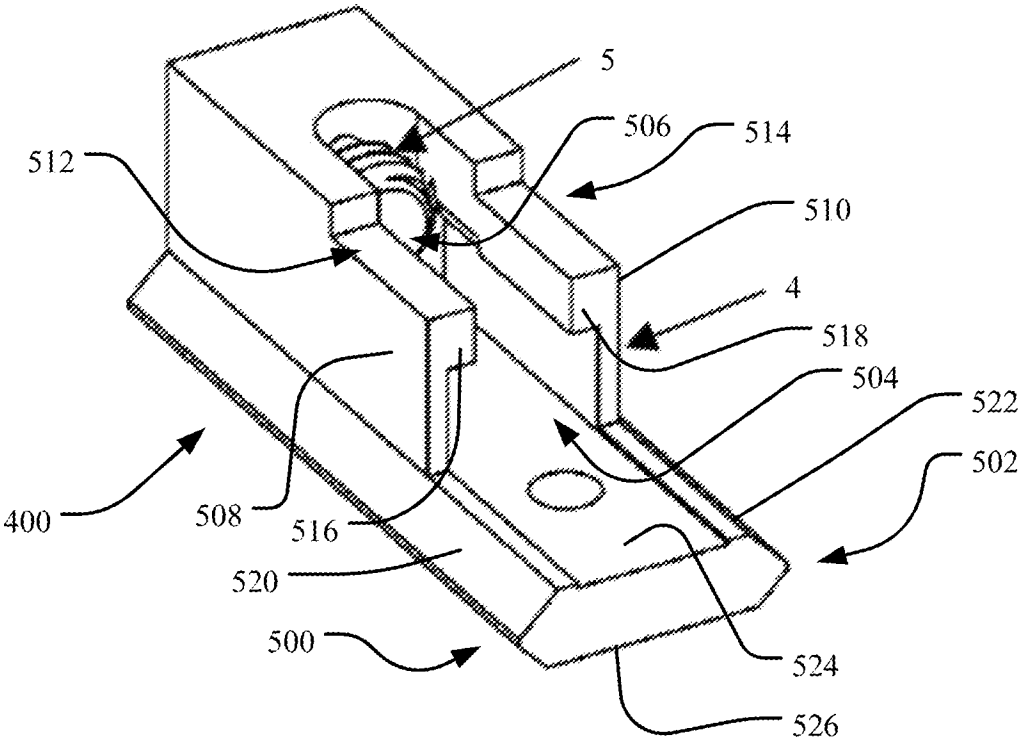
FIG. 5 is an isometric view of the lug adapter from a different angle than FIG. 4.

FIG. 5 is an isometric view of the lug adapter 4 from a different angle than FIG. 4. The rail base 400 has a first surface 520 and a second surface 522 opposite to the first surface 520 and further comprises a third 524 and fourth 526 surfaces that adjoin the first 520 and second surface 522. The rail base 400 further includes a first flange 500 protruding from the first surface 520 and a second flange 502 protruding from the second surface 522. The cross section of the first flange 500 and second flange 502 may be any shape including, but not limited to, a curve, oval, square, or the like. For example, the cross section shown in FIG. 5 is a triangle. The first 500 and second flanges 502 are configured to be partially received by the grenade launcher rail 11 and are configured to operably couple the lug adapter 4 to the grenade launcher 7.

The housing 402 includes a front lug receiving portion 504 and an adjustment screw receiving portion 506. The adjustment screw receiving portion 506 may be a threaded opening 410, shown in FIG. 4, wherein the threaded opening 410 is configured to receive the adjustment screw 5. The adjustment screw 5 can extend through the housing 402 and can be operable to contact the front lug 6 at a distal end and may be operable to receive a fastener at a proximal end opposite the distal end. The front lug receiving portion 504 may be further defined by a first wall 508 extending from the rail base 400 and a second wall 510 extending from the rail base 400. The first 508 and second wall 510 have a first step 512 and a second step 514, respectively, wherein the first step 512 and second step 514 are operable to accommodate a portion of the front lug 6. In other words, the first 512 and second 514 steps are cutouts on the housing 402 which allow the lug adapter 4 to be positioned such that the lug adapter 4 can both contact the front lug 6 and slide into position on the grenade launcher rail 11, as shown in FIG. 2. Returning to FIG. 5, the first 508 and second wall 510 may also have a first wall flange 516 and a second wall flange 518. The first 516 and second 518 wall flanges protrude inward towards each other and receive a coupler 13 shown in FIG. 1 of the front lug 6. The first 516 and second 518 wall flanges prevent the lug adapter 4 from moving downward during use.

FIGS. 6-14 illustrate an example installation of the lug adapter 4 to the grenade launcher 7 and the assembled lug adapter 4 with the grenade launcher 7 to the firearm 10 using a tool. The tool may be, for example, a hex key driver.

Figure 6:
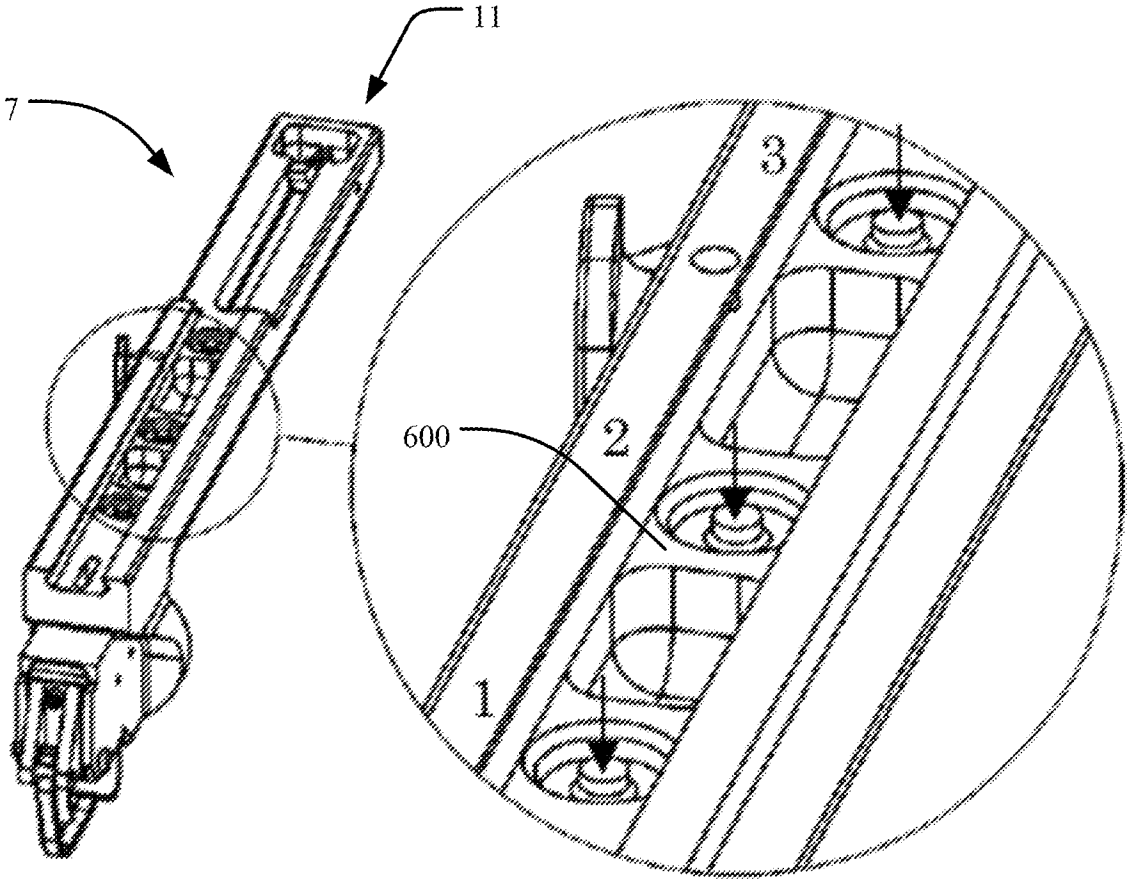
FIG. 6 illustrates an isometric view of a grenade launcher rail for the grenade launcher.

FIG. 6 illustrates an isometric view of the grenade launcher rail 11 of the grenade launcher 7. Using the tool, the launcher rail set screws 1, 2, & 3 are screwed downward, shown by the arrows, until they are below a rail slot top surface 600 or removed.

Figure 7:
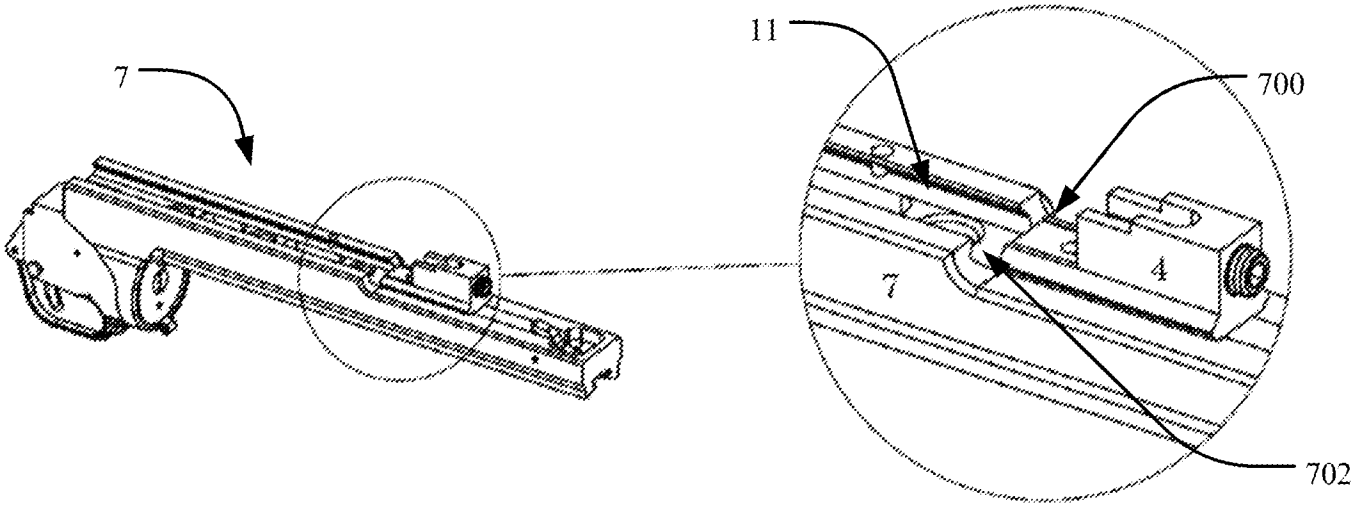
FIG. 7 illustrates an isometric view of the lug adapter being inserted into the grenade launcher rail of FIG. 6.

FIG. 7 illustrates an isometric view of the lug adapter 4 being inserted into the grenade launcher rail 11 of FIG. 6. The male rail 700 of the lug adapter 4, the male rail 700 being the first 500 and second flanges 502 of the rail base 400, is aligned with the female rail 702 of the grenade launcher 7.

Figure 8:
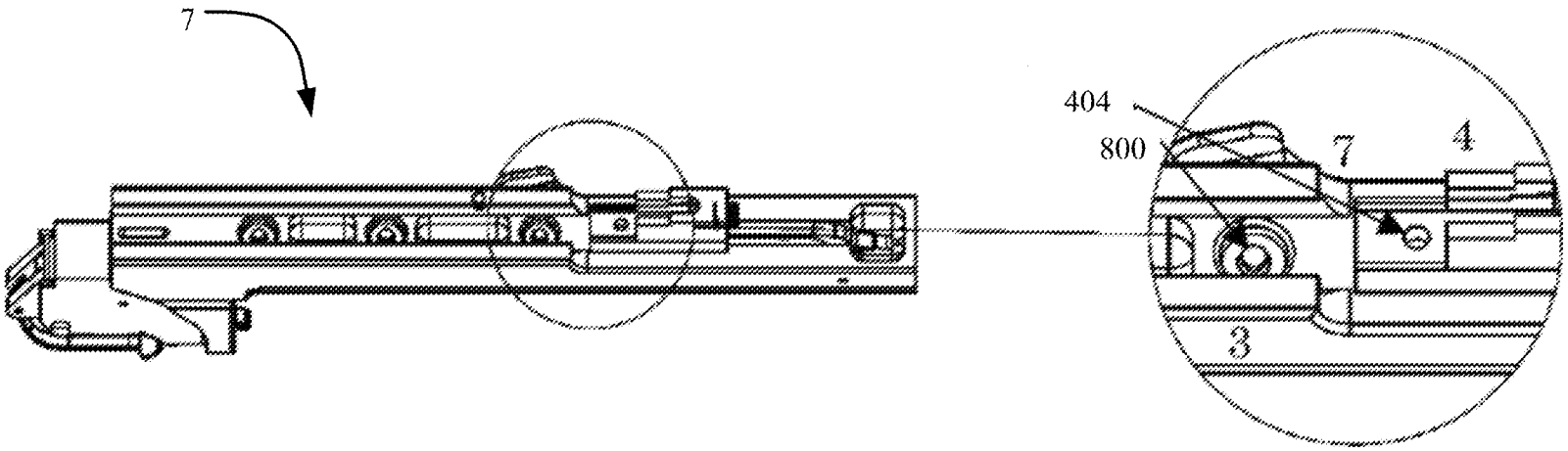
FIG. 8 illustrates an isometric view of the lug adapter being aligned with an installation position on the grenade launcher rail of FIG. 6.

FIG. 8 illustrates an isometric view of the lug adapter 4 being aligned with an installation position 800 on the grenade launcher rail 11 of FIG. 6. The lug adapter 4 is slid into the grenade launcher rail 11 until the opening 404 of the lug adapter 4 is aligned with the tip of the launcher rail set screw 3.

Figure 9:
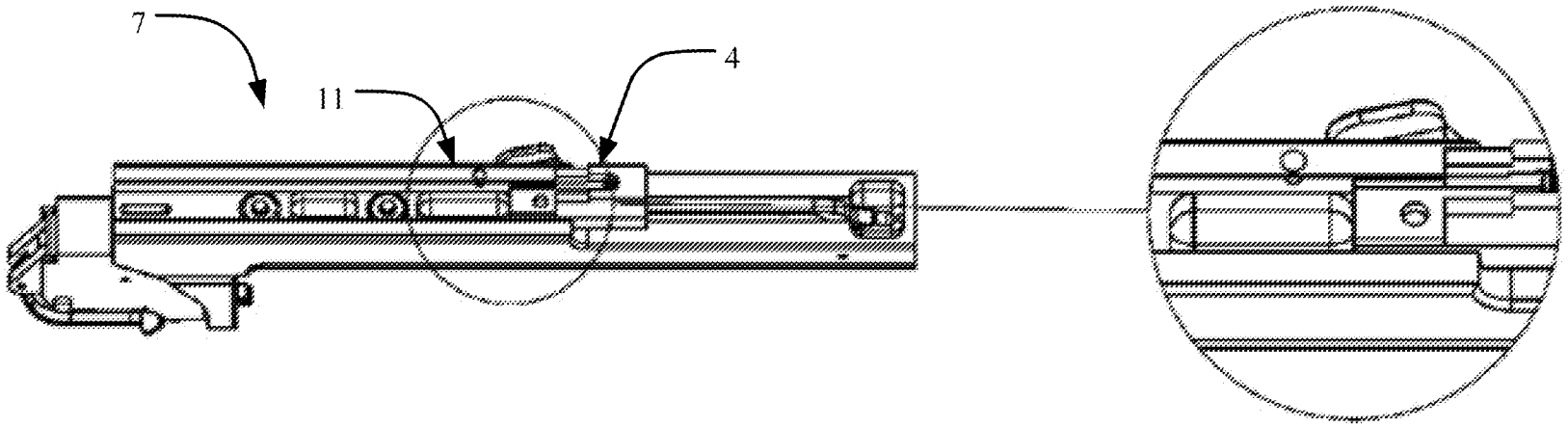
FIG. 9 illustrates an isometric view of the lug adapter being attached to the grenade launcher rail of FIG. 6.

FIG. 9 illustrates an isometric view of the lug adapter 4 being attached to the grenade launcher rail 11 of FIG. 6. The tool may be used to tighten the launcher rail set screw 3 to secure the lug adapter 4 to the grenade launcher 7.

Figure 10:
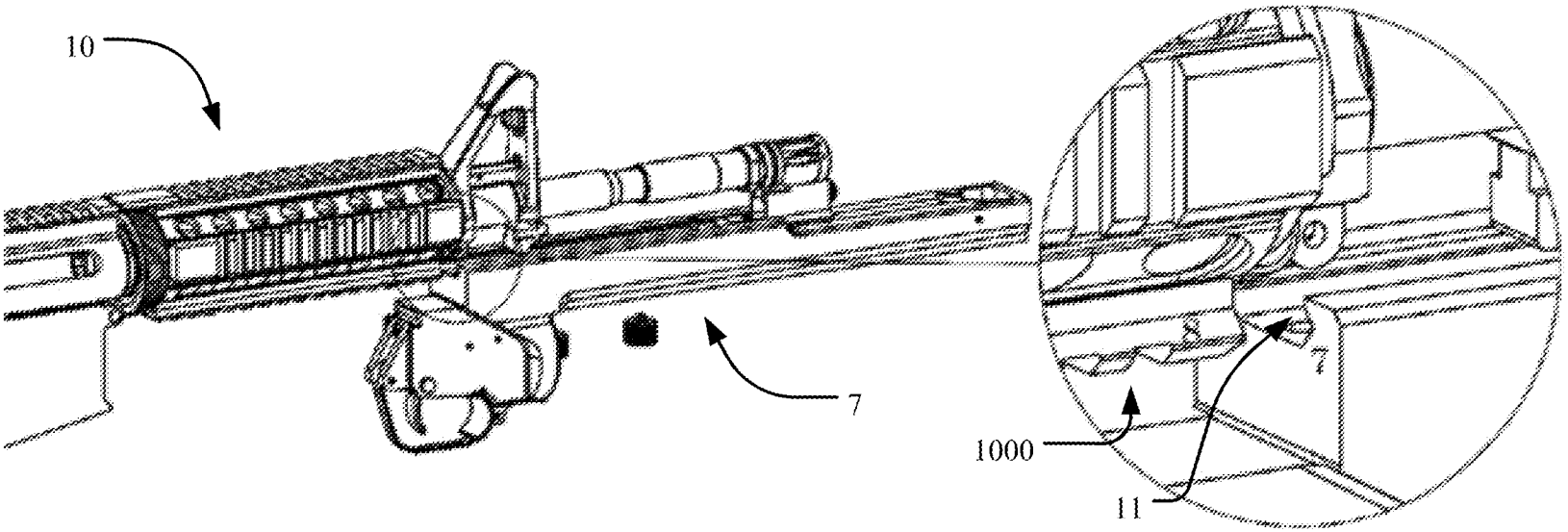
FIG. 10 illustrates an isometric view of the grenade launcher being aligned and received with a lower rail of the firearm.

FIG. 10 illustrates an isometric view of the grenade launcher being aligned and received by the lower rail 1000 of the firearm 10. The grenade launcher rail 11 can be aligned with the quad-rail handguard 8 lower rail 1000

Figure 11:
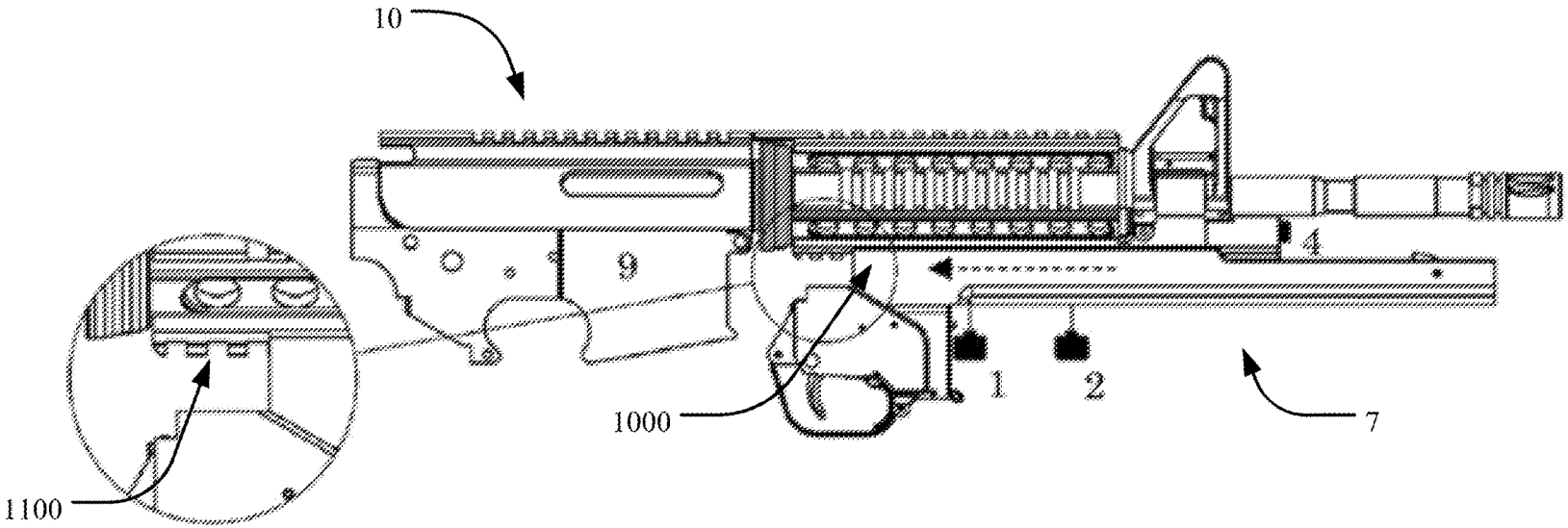
FIG. 11 illustrates a side elevation view including an enlarged view of the grenade launcher being installed on the lower rail of the firearm including the lug adapter sliding into the front lug.

FIG. 11 illustrates a side elevation view including an enlarged view of the grenade launcher 7 being installed on the lower rail 1000 of the firearm 10 including the lug adapter 4 sliding into the front lug 6. The grenade launcher 7 is slid toward the rifle receiver 9 until the grenade launcher 7 is spaced from a plurality of end rail notches 1100, while the lug adapter 4 also slides onto the front lug 6.

Figure 12:
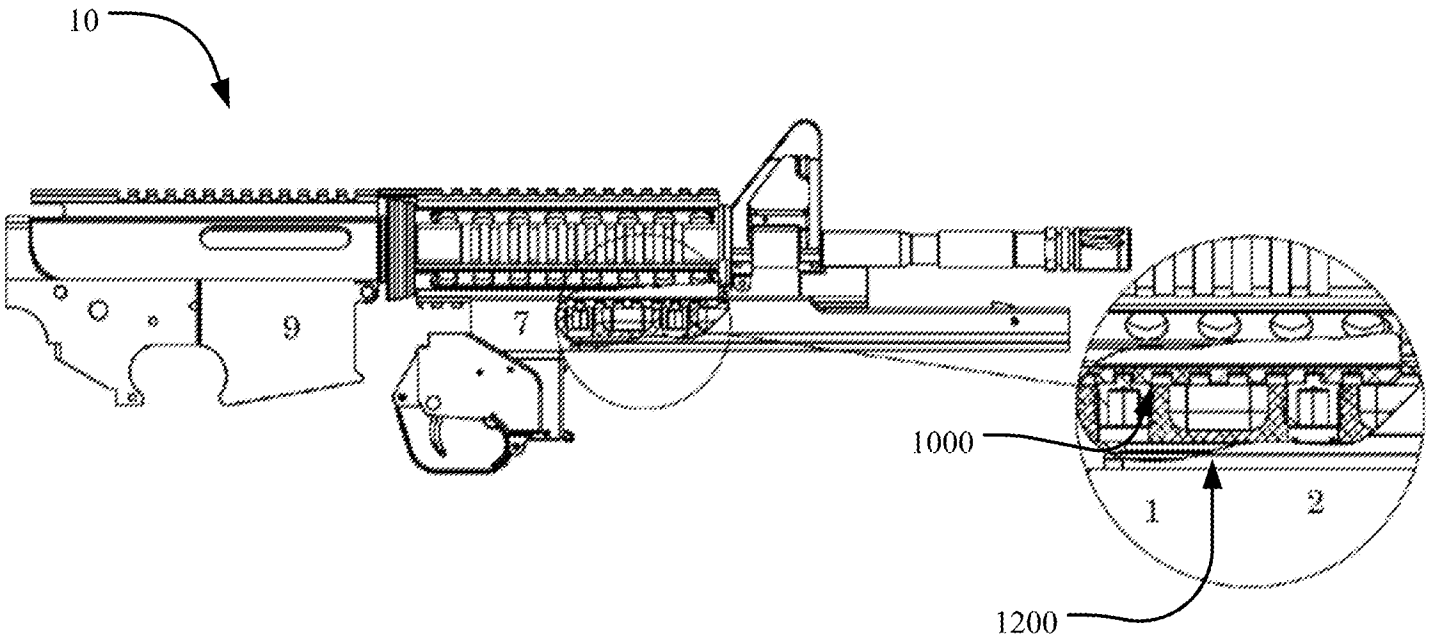
FIG. 12 illustrates a side elevation view and partial cross-section view of the firearm including the lower rail into which a plurality of launcher rail set screws are installed.

FIG. 12 illustrates a side elevation view and partial cross-section view of a firearm 10 including a lower rail 1000 into which the launcher rail set screws 1, 2 are installed. The tool may be used to tighten the launcher rail set screws 1 and 2 onto the quad-rail handguard 8. The launcher rail set screws 1, 2 may be mounted between a plurality of picatinny rail lugs 1200.

Figure 13:
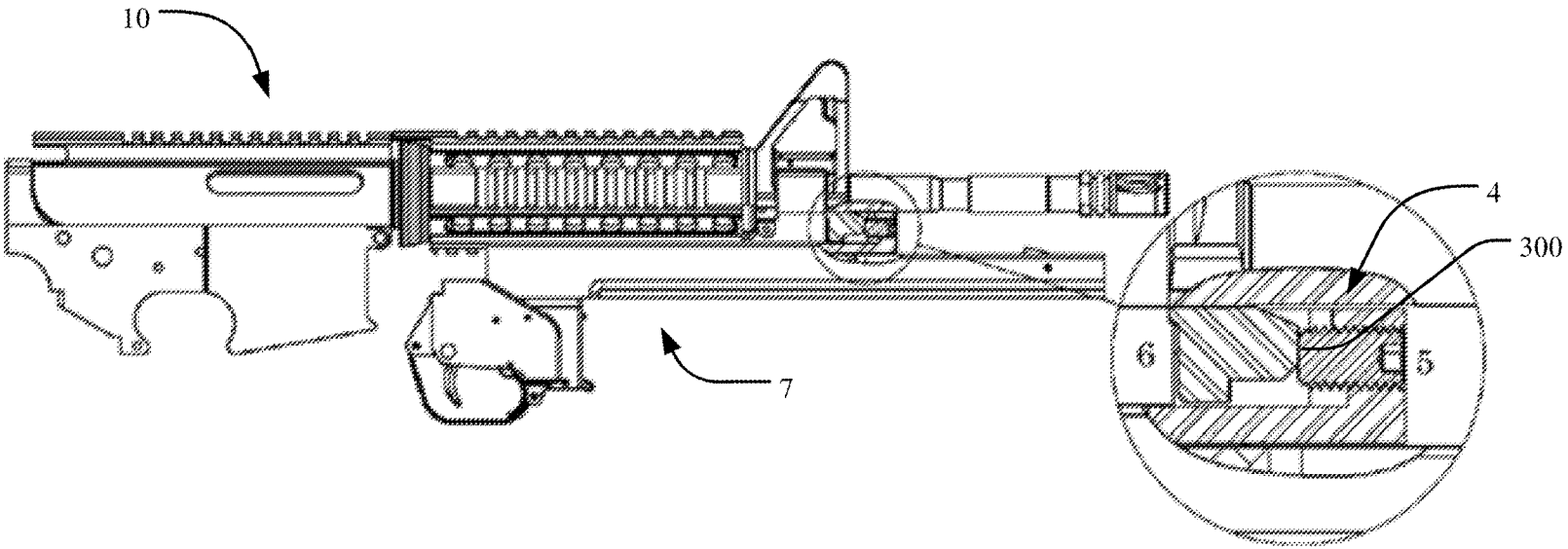
FIG. 13 illustrates a side elevation view and partial cross-section view of the firearm including the lug adapter being coupled to the front lug.

FIG. 13 illustrates a side elevation view and partial cross-section view of a firearm 10 including the lug adapter 4 being coupled to the front lug 6. The close up view illustrates the contact between the front face 300 of the front lug 6 and the adjustment screw 5

Figure 14:
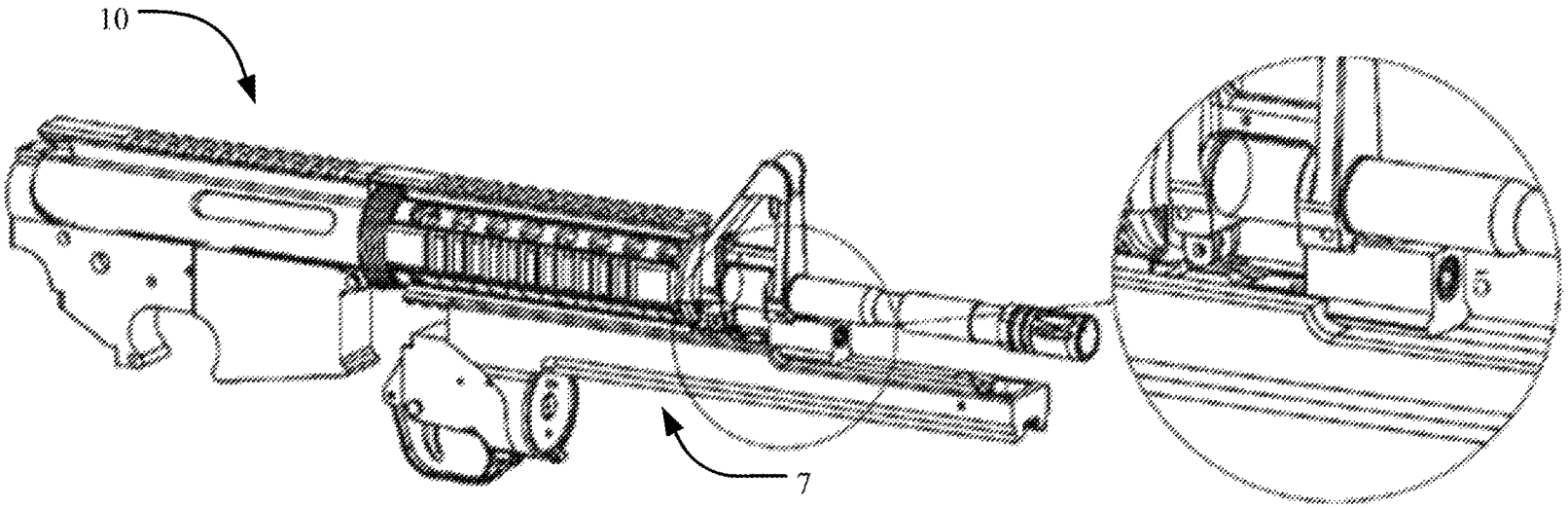
FIG. 14 illustrates an isometric view of the firearm including the lug adapter being coupled to the front lug.

FIG. 14 illustrates an isometric view of the firearm 10 including the lug adapter 4 being coupled to the front lug 6. The tool may be used to tighten the adjustment screw 5 until the adjustment screw 5 contacts the front lug 6 front face 300. The adjustment screw 5 may be tightened until snug, but should not be over tightened as damage to the quad-rail handguard 8 and other components may occur. Tightened adjustment screw 5 position may not exactly match what is shown in FIG. 14 and the depth may vary.

Under usage of a grenade launcher 7 with the lug adapter 4, no recoil should cause the grenade launcher 7 to slide on the quad-rail handguard 8. If movement occurs, ensure all launcher rail set screws 1, 2, and 3 are correctly positioned, tightened, and snug. Do not overtighten, damage to quad-rail handguard 8 and other components may occur.

The description above includes example systems, methods, and/or techniques, products that embody techniques of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A mounting system operable to couple a grenade launcher to a firearm, the mounting system comprising:

a rail system operable to be coupled to a firearm, the rail system comprising at least one rail that is mounted on an underside of a barrel of the firearm that is opposite to sights mounted on an upperside of the barrel;

a front lug that is coupled to the barrel in front of the rail system and aligned with the at least one rail;

a grenade launcher rail that is operable to be coupled to the grenade launcher; and a lug adapter operable to be coupled to the grenade launcher rail and the front lug, wherein the lug adapter includes a rail base that is operable to be slidingly coupled with the grenade launcher rail.

2. The mounting system of claim 1, wherein a first and second flanges of the rail base of the lug adapter are partially received by the grenade launcher rail and operably couple the lug adapter to the grenade launcher rail.

3. The mounting system of claim 1, wherein the lug adapter comprises a housing forming a front lug receiving portion that is operable to receive a front lug of a firearm and an adjustment screw receiving portion having a threaded opening substantially parallel to the rail base.

4. The mounting system of claim 3, wherein the housing protrudes above the rail base, and the front lug receiving portion of the housing operably abutingly engages the front lug.

5. The mounting system of claim 1, wherein the rail base has a first surface and a second surface opposite to the first surface, the rail base further comprising a third and fourth surfaces that adjoin the first and second surface.

6. The mounting system of claim 5, further comprising a first flange protruding from the first surface and a second flange protruding from the second surface, wherein the housing protrudes from a third surface and the opening is positioned on the third surface.

7. The mounting system of claim 6, wherein the first and second flanges have a triangular cross section.

8. The mounting system of claim 1, wherein the lug adapter comprises a first wall extending from the rail base and a second wall extending from the rail base, the first wall and second wall have a first step and a second step, respectively, wherein the first step and the second step are operable to accommodate a portion of the front lug.

9. The mounting system of claim 8, wherein the first wall and second wall have a first wall flange and a second wall flange, respectively, wherein the first wall flange and second wall flange protrude inward towards each other and receive a coupler of the front lug.

10. A lug adapter operable to couple a grenade launcher rail to a front lug of a firearm, the lug adapter comprising:

a rail base that is operable to be received by a grenade launcher rail, the rail base having a first end and a second end, the second end being opposite the first end, the rail base forming an opening near the first end, the opening being operable to receive a set screw;

a housing protruding from the rail base at the second end and extending towards the first end, the housing forming a front lug receiving portion that is operable to receive a front lug of a firearm and an adjustment screw receiving portion having a threaded opening substantially parallel to the rail base; and an adjustment screw that is operable to be received in the adjustment screw receiving portion formed in the housing, wherein the adjustment screw is operable to engage the housing with the front lug.

11. The lug adapter of claim 10, wherein the adjustment screw extends through the housing and is operable to contact the front lug at a distal end and operable to receive a tool at a proximal end opposite the distal end.

12. The lug adapter of claim 10, wherein the rail base has a first surface and a second surface opposite to the first surface, the rail base further comprising a third and fourth surfaces that adjoin the first and second surface.

13. The lug adapter of claim 12, further comprising a first flange protruding from the first surface and a second flange protruding from the second surface, wherein the housing protrudes from a third surface and the opening is positioned on the third surface.

14. The lug adapter of claim 13, wherein the first and second flanges have a triangular cross section.

15. The lug adapter of claim 10, wherein the housing comprises a first wall extending from the rail base and a second wall extending from the rail base, the first wall and second wall have a first step and a second step, respectively, wherein the first step and the second step are operable to accommodate a portion of the front lug.

16. The lug adapter of claim 15, wherein the first wall and second wall have a first wall flange and a second wall flange, respectively, wherein the first wall flange and second wall flange protrude inward towards each other and receive a coupler of the front lug.

17. The lug adapter of claim 15, wherein the housing protrudes above the rail base, and the front lug receiving portion of the housing operably abutingly engages the front lug.

* * * * *